US012600508B2

(12) United States Patent
Wang

(10) Patent No.: US 12,600,508 B2
(45) Date of Patent: Apr. 14, 2026

(54) WATER POLO WATER INJECTION ASSEMBLY AND WATER POLO WATER INJECTION DEVICE

(71) Applicant: Bo Wang, Hebei (CN)

(72) Inventor: Bo Wang, Hebei (CN)

( * ) Notice: Subject to any disclaimer, the term of this patent is extended or adjusted under 35 U.S.C. 154(b) by 120 days.

(21) Appl. No.: 18/591,442

(22) Filed: Feb. 29, 2024

(65) Prior Publication Data

US 2024/0294283 A1 Sep. 5, 2024

(30) Foreign Application Priority Data

Mar. 1, 2023 (CN) ..... 202310182568.9
Jun. 2, 2023 (CN) ..... 202310649018.3

(51) Int. Cl.
*B65B 3/10* (2006.01)
*A63H 27/10* (2006.01)

(52) U.S. Cl.
CPC ..... *B65B 3/10* (2013.01); *A63H 27/10* (2013.01); *A63H 2027/1083* (2013.01)

(58) Field of Classification Search
CPC .... B65B 3/10; A63H 2027/1083; A63H 27/10
See application file for complete search history.

(56) References Cited

U.S. PATENT DOCUMENTS

| | | | | |
|---|---|---|---|---|
| 9,315,282 | B2 | 4/2016 | Malone | |
| 2011/0079316 | A1 | 4/2011 | Ramere | |
| 2015/0259085 | A1* | 9/2015 | Malone | A61B 5/1427 |
| 2017/0043270 | A1* | 2/2017 | Harter | A63H 27/10 |
| 2017/0225809 | A1* | 8/2017 | Kamhi | B65B 7/025 |
| 2018/0272242 | A1 | 9/2018 | Watson | |

* cited by examiner

*Primary Examiner* — Jason K Niesz

(57) ABSTRACT

The invention provides a water polo water injection assembly and a water polo water injection device. The water polo water injection assembly omits disassembly with an external water pipe or a water injection cylinder, is convenient to use, and is uniformly filled with water polo. The injection tube bundle is short in length, low in processing cost, wide in application range and low in water pressure requirement The water polo water injection device realizes continuous water extraction and pressure injection, thus realizing water polo water injection without the aid of water pipes, convenient use, uniform water polo water filling and simple replacement.

14 Claims, 13 Drawing Sheets

WATER POLO WATER INJECTION ASSEMBLY AND WATER POLO WATER INJECTION DEVICE

CROSS REFERENCE TO RELATED APPLICATION

This application claims priority benefit of Chinese Patent Application No. 202310649018.3, filed on Jun. 2, 2023, and Chinese Patent Application No. 202310182568.9, filed on Mar. 1, 2023, and the entire contents of which are incorporated herein by reference.

TECHNICAL FIELD

The invention relates to the technical field of water polo injection, in particular to a water polo injection component and a water polo injection device.

TECHNICAL BACKGROUND

Water-filled balloons are made of natural latex and can be used for water fights, outdoor parties and other entertainment projects. In the existing water-filled balloon technology, water pipes are mainly used to connect the water-filled interface of water polo, and a string of balloon struts are connected under the interface. The balloons are tied with rubber bands under the balloon struts and connected with the balloons. The water pressure of the water pipes is used to directly fill the balloons, and the balloons can be dropped by shaking them by hand after water filling. This structure can only be filled with water pipes with a certain water pressure and a specific size, so the application occasions are greatly limited. At the same time, in order to reduce the trouble of water filling back and forth, the number of each string of balloons is large, but the phenomenon of uneven water filling size is easy to occur due to the violent fluctuation of water pressure during the water filling process. Correspondingly, because the balloons expand after water filling, the balloon struts need to be very long to ensure that there is enough space for a string of balloons to expand without squeezing each other, resulting in great waste of balloon struts. And every time the water is injected, it is necessary to remove the water polo water injection interface from the water pipe, which is cumbersome to operate. In addition, due to the large number of balloons in each string mentioned above, besides being unsuitable for small demand and unable to control the number of balloons, the requirement for water pressure is relatively high, and the balloon water filling effect is greatly reduced when the water flow and water pressure are small. Moreover, the water polo water injection interface is generally set for standard-sized water pipes, and is not suitable for non-standard-sized water pipes and hoses, so the application range is small. Correspondingly, due to the expansion of the balloon after being filled with water, the balloon support rods need to be very long to provide enough space for a string of balloons to expand without squeezing each other, resulting in a significant waste of balloon support rods. And every time the water is injected, the water ball filling interface needs to be removed from the water pipe, making the operation cumbersome. In addition, due to the large number of balloons in each string mentioned above, it is not suitable for small demand and cannot control the number of balloons, resulting in a lot of waste. In addition, the water pressure requirement is correspondingly high. When the water flow and water pressure are low, the water filling effect of the balloons is greatly reduced. And the water ball water injection interface is generally set for standard size water pipes and is not suitable for non-standard size water pipes and hoses, so the adaptability range is relatively small.

SUMMARY OF THE INVENTION

The invention provides a water polo water injection assembly and a water polo water injection device. The water polo water injection assembly omits disassembly with an external water pipe or a water injection cylinder, is convenient to use, and is uniformly filled with water polo. The injection tube bundle is short in length, low in processing cost, wide in application range and low in water pressure requirement The water polo water injection device realizes continuous water extraction and pressure injection, thus realizing water polo water injection without the aid of water pipes, convenient use, uniform water polo water filling and simple replacement In order to achieve the above objectives, the present invention provides the following technical scheme:

A water polo water injection assembly comprises a connecting part, wherein the connecting part is provided with a first water inlet channel and can be connected with an external water pipe or an external water injection cylinder; A water injection seat, wherein a plurality of water outlet holes are arranged on the water injection seat, and an injection tube bundle communicated with the water outlet holes is arranged on each water outlet hole; The conversion seat is provided with two opposite clamping grooves, the shape of the water injection seat is matched with the opening area surrounded by the two clamping grooves, and the water injection seat can be just inserted into the two clamping grooves; The open area surrounded by the two clamping grooves has a structure of large inside and small outside, the small end of the opening can be used for the injection tube bundle to pass through, and the first water inlet channel is communicated with the large end of the opening. When the water injection seat is inserted into the two clamping grooves, the water flowing out of the first water inlet channel can flow into the injection tube bundle through the water outlet hole. It is connected with an external water pipe or an external water injection cylinder through the connecting part, and the water inlet channel can be connected with the water outlet hole and the injection tube bundle only by inserting the water injection seat into two opposite clamping grooves, so that the balloon is fixed on the injection tube bundle, and the water flowing out of the water inlet channel is injected into the balloon through the water outlet hole and the injection tube bundle. After the balloon is filled with water, only the water injection seat can be unplugged and replaced, so that frequent and complicated disassembly with external water pipes or water injection cylinders is omitted, and the installation, disassembly and use are simple and practical.

The water injection seat is basically rectangular, the water outlet holes are provided with at least one row, a water diversion cavity which is concave and can cover the water outlet holes is arranged on the water injection seat, the far outlet hole side of the water diversion cavity is open, the near outlet hole side is connected with the water outlet hole, and clamping edges are arranged on two opposite sides of the water injection seat. By arranging the water diversion cavity which is concave and can cover the water outlet holes on the water injection seat, the water flowing out of the water inlet channel is evenly distributed through the water diversion cavity and then pressed into the corresponding balloon through the respective water outlet holes, so as to ensure the uniform water filling of the water balloons. The water outlet holes are arranged in rows on the water injection seat instead of radial in the past, so that the water balls between two adjacent rows are staggered in front, back, left and right after being filled with water, which can further reduce the expansion range, thus reducing the length of the corresponding injection tube bundle and saving the processing cost of the injection tube bundle.

The connecting part and the conversion seat are integrally formed, the water outlet holes are provided with one to five rows, the length of the injection tube bundle is 4 cm-20 cm, the diameter of the injection tube bundle is 1.5 mm-3 mm, the connecting part and the conversion seat are integrally formed, the length of the injection tube bundle is small, and the injection tube bundle is simple to process, easy to form and low in cost.

The connecting part is provided with a first threaded part. The connection part is connected with an external water pipe or an external water injection cylinder through that first threaded part, so that water can be injected into the balloon through the water inlet channel, the water diversion cavity, the water outlet hole and the injection tube bundle.

The first water inlet channel is provided with a funnel-shaped connecting channel, and the funnel-shaped connecting channel is arranged between the connecting part and two opposite clamping grooves. The funnel-shaped connecting channel is easier to process and shape, and can adapt to the quick connection of tapered hoses, with strong practicability and extremely convenient operation.

The invention also comprises a conversion head, wherein the conversion head is provided with a conversion channel; the upper section of the inner wall of the conversion head is provided with a third threaded part; the lower section of the inner wall of the conversion head is provided with a second threaded part matched with the first threaded part; and when the connecting part is in threaded connection through the first threaded part and the second threaded part, the conversion channel is communicated with the first water inlet channel. When facing a water pipe with nonstandard threads or an external water injection cylinder with nonstandard threads, the adapter is arranged and connected with the first threaded part of the connecting part, and the connecting part is connected with the water pipe with nonstandard threads or the external water injection cylinder with nonstandard threads by using the third threaded part of the adapter, so that the application range is wide.

When there are two to five rows of water outlet holes, two adjacent rows of water outlet holes are staggered, the length of the injection tube bundle is 4 cm-15 cm, and the diameter of the injection tube bundle is 1.5 mm-2.5 mm. After the water balls between two adjacent rows are filled with water, they are staggered in front, back, left and right to further reduce the expansion range, thus reducing the length of the corresponding injection tube bundle and saving the processing cost of the injection tube bundle.

A hand-held part is arranged on the water injection seat. The water injection seat is more convenient to plug in and out.

The clamping grooves are provided with two or more groups, and each group of clamping grooves is arranged in parallel or in axial array and integrally formed with the connecting part. In this way, water can be injected into multiple groups of balloons on multiple water injection seats at the same time, further improving the water injection speed of balloons.

Also comprise a water seal plug, wherein that shape of the water sealing plug is matched with the area enclose by the two clamping grooves, and the water sealing plug can be just inserted into the two clamping grooves. When the water flow and water pressure are small or there are few balloons needing water injection, the water sealing plug can be inserted into one group of clamping grooves or two groups of clamping grooves, so that the number of balloons injected with water once and the water pressure injected into the balloons through the water outlet and the injection tube bundle can be adjusted to ensure the balloon water filling effect, and the requirement for water pressure is low.

The same side of that two clam grooves is provide with a limiting surface, so that an operator can quickly distinguish the insertable direction of the clamping grooves, and the operation is more convenient.

The thickness of the water injection seat has a wedge-shaped tendency to gradually narrow from the near hand-held part side to the far hand-held part side, and the opening big ends of the two clamping grooves have a wedge-shaped tendency to gradually narrow from the far limit surface side to the near limit surface side, so that the connection between the water injection seat and the two clamping grooves is more compact, and water cannot overflow from the connection between the water injection seat and the two clamping grooves.

A balloon is arranged on the injection tube bundle, and when the water injection seat is inserted into the two clamping grooves, water flowing out of the water inlet channel is injected into the balloon through the water outlet hole and the injection tube bundle.

On the other hand, in order to realize the continuous extraction and pressurized injection of water, water polo is injected, without the help of water pipes, which is convenient to use, uniform in water filling and simple to replace. The invention also provides a water polo water injection assembly, a water polo water injection device, which comprises a water injection barrel and a water polo water injection assembly, wherein the water polo water injection assembly comprises a connecting part with a first water inlet channel; A water injection seat, wherein a plurality of water outlet holes are arranged on the water injection seat, and an injection tube bundle communicated with the water outlet holes is arranged on each water outlet hole; The conversion seat is provided with two opposite clamping grooves, the shape of the water injection seat is matched with the opening area surrounded by the two clamping grooves, and the water injection seat can be just inserted into the two clamping grooves; The open area surrounded by the two clamping grooves has a structure that the inside is large and the outside is small, the small end of the opening can be passed by the injection tube bundle, and the first water inlet channel is communicated with the big end of the opening. When the water injection seat is inserted into the two clamping grooves, the water flowing out of the first water inlet channel can flow into the injection tube bundle through the water outlet hole; The water injection cylinder is provided with a water outlet, and the water outlet is communicated with the first water inlet channel of the connecting part.

Characterized in that there is an injection head that can slide up and down inside the water injection cylinder, and the injection head is connected to the injection rod, which protrudes from the outside of the water injection cylinder, A first one-way control valve is provided on the injection head that only allows water to flow from the injection tube on the injection rod side to the injection tube on the far injection rod side; A water outlet is provided on the far injection rod side of the water injection cylinder, which is connected to the water ball injection component through the water outlet;

A sealing cover is provided on the far outlet side of the water injection cylinder, which is covered on the water injection cylinder. An inlet is provided on the far outlet side or the sealing cover of the water injection cylinder, and a through-hole is provided on the sealing cover for the injection rod to move up and down, The injection rod passes through the through-hole and is sealed and connected to the sealing cover through a sealing gasket.

The water inlet is provided with a second one-way control valve which only allows water to flow from the outside of the water injection cylinder to the inside of the water injection cylinder.

The second one-way control valve is a check valve or a flexible rubber pad, and when the second one-way control valve is a flexible rubber pad, the flexible rubber pad can cover the water inlet.

The second one-way control valve is a flexible rubber pad, and the gasket and the second one-way control valve are separately arranged on the sealing cover.

The sealing gasket covers the water inlet, and a support pad penetrates the injection rod, which can slide up and down on the injection rod and is arranged below the sealing gasket.

The water inlet is connected with the flexible pipe through a water inlet channel, and a drawing handle is arranged on the injection rod.

The first one-way control valve comprises a first circulation hole penetrating the injection head and a flexible pad, and the flexible pad is arranged on the far injection rod side and can cover the first circulation hole.

The first one-way control valve comprises a baffle plate adapted to the inner wall of the water injection cylinder, the injection head is in clearance fit with the inner wall of the water injection cylinder, the baffle plate is connected with the injection head and can slide up and down together with the injection head, a free washer is arranged between the baffle plate and the injection head, the free washer can freely move up and down between the baffle plate and the injection head, the outer diameter of the free washer is larger than the inner diameter of the water injection cylinder, the inner diameter of the free washer is smaller than the diameter of the injection head, and a second flow conversion is arranged on the baffle plate.

The baffle is connected with the injection head through a connecting rod, and the connecting rod is provided with a third circulation switching hole, and the second circulation switching hole is connected with the third circulation switching hole through.

A plurality of protrusions are arranged on the edge of the injection head, and the protrusions are matched with the inner diameter of the water injection cylinder.

The support pad can cover the sealing gasket, and a limiting column is arranged on the support pad, which penetrates through the injection rod and abuts against the sealing gasket, and a circulation hole is formed on the support pad.

The water injection cylinder and the connecting part are integrally formed or detachably connected; When the water injection cylinder is detachably connected with the connecting part, the water injection cylinder is in threaded connection, clamped or interference fit with the connecting head.

It can be seen from the above technical scheme that the injection head is provided with the first one-way control valve which only allows the water in the injection cylinder to flow from the injection rod side to the far injection rod side, and the injection rod is connected with the water injection cylinder in a sealed manner, so that the interior of the water injection cylinder is divided into two parts; when the injection rod is pushed to move the injection head from top to bottom, the lower part of the water injection cylinder is compressed to pressurize the water in the lower part of the water injection cylinder, and the water is injected into the balloon through the water outlet, the connector, the water outlet hole and the injection tube bundle, and at this time, the upper space of the water injection cylinder gradually increases to form When the injection rod drives the injection head to move from bottom to top, the lower part of the water injection cylinder forms negative pressure, and the water in the upper part of the water injection cylinder flows from the injection rod side to the far injection rod side through the first one-way control valve, so that the lower part of the water injection cylinder is filled with water, thereby realizing continuous water extraction and pressurized injection, and further realizing water polo injection. By arranging two opposite clamping grooves on the connector, and inserting the water injection seat matched with the shapes of the two clamping grooves into the two clamping grooves, the water diversion cavity is connected with the water outlet, and the area surrounded by the two clamping grooves covers the water diversion cavity to realize the sealed connection between the connector and the water injection seat, so that water is injected into the balloon through the water outlet, the connector, the water outlet and the injection tube bundle. By arranging the water diversion cavity which is concave and can cover all the water outlet holes on the water injection seat, the water flowing out of the water outlet is evenly distributed through the water diversion cavity and then pressed into the corresponding balloon through the respective water outlet holes, so as to ensure the uniform water filling of the water balloon. The water outlet holes are arranged in rows on the water injection seat instead of radial in the past, so that the water balls between two adjacent rows are staggered in front, back, left and right after being filled with water, which can further reduce the expansion range, thus reducing the length of the corresponding injection tube bundle and saving the processing cost of the injection tube bundle.

BRIEF DESCRIPTION OF DRAWINGS

The accompanying drawings, which constitute a part of this application, are used to provide a further understanding of the invention, and the illustrative embodiments of the invention and their descriptions are used to explain the invention, and do not constitute undue limitations on the invention. Among them.

Figure 1:
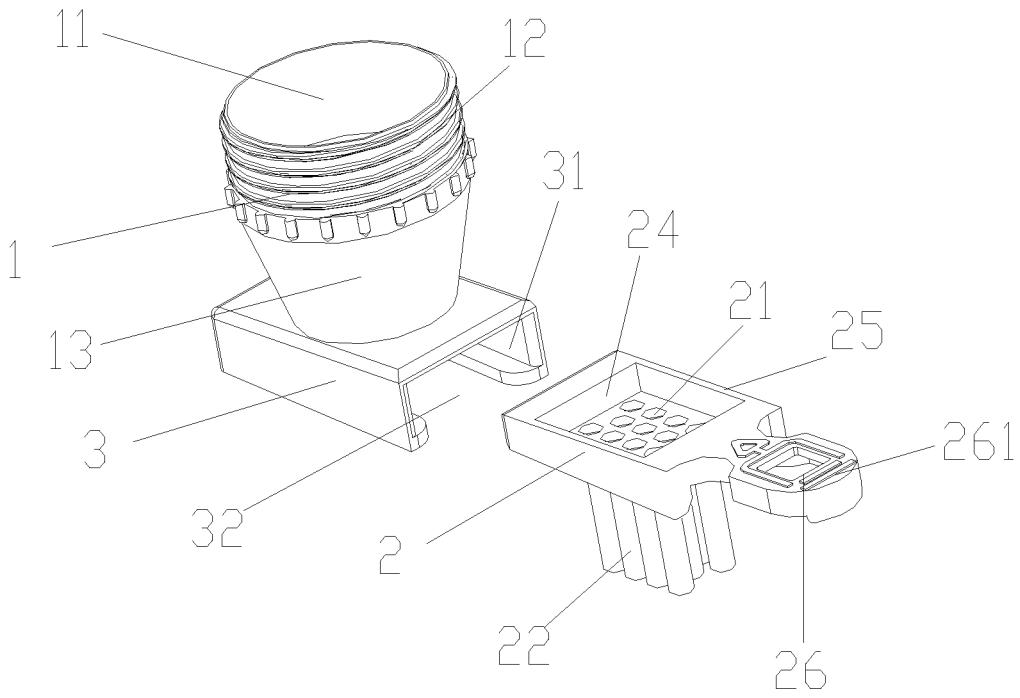
FIG. 1 is a schematic exploded view of an embodiment of the water polo water injection assembly (excluding the balloon and the conversion head)
Figure 2:
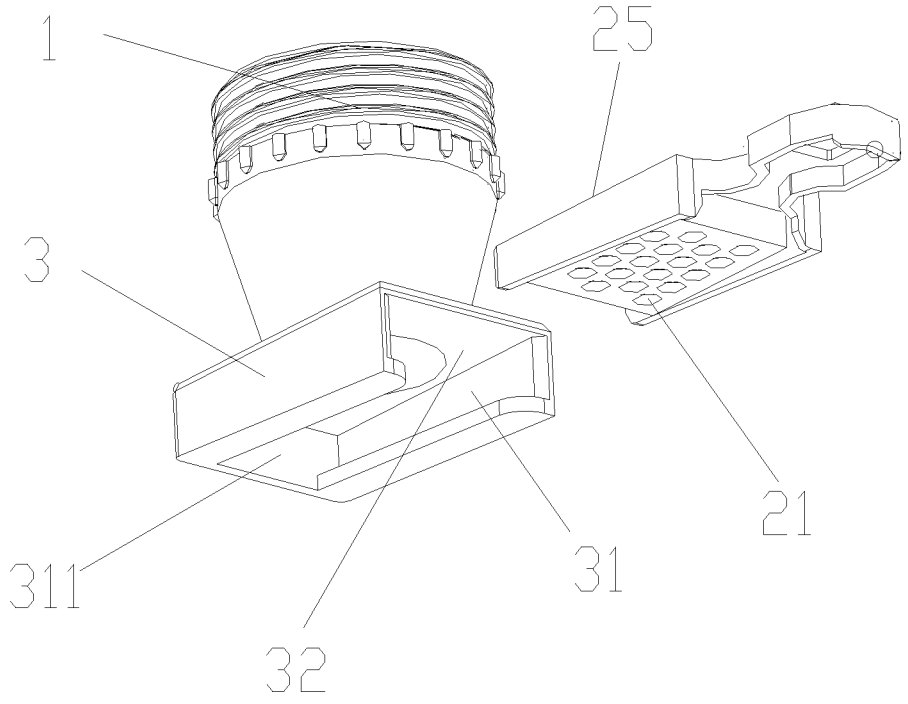
FIG. 2 is a schematic diagram of another perspective exploded state of an embodiment of the water polo water injection assembly (excluding the conversion head and omitting the injection tube bundle)

Description of reference numerals: 1—connecting part; 11—First water inlet channel; 12—first threaded part; 13—Funnel-shaped connecting channel; 14—connector; 141—second water inlet channel; 2—Water injection seat; 21—water outlet; 22—Injection tube bundle; 23—Balloon; 24—water diversion cavity; 25—clamping edge; 26—Handheld part; 261—handle; 3—conversion seat; 31—clamping slot; 311—limit surface; 32—opening; 4—switching head; 41—conversion channel; 42—second threaded part; 43—the third threaded part; 5—water sealing plug; 6—water injection cylinder; 60—water outlet; 61—injection head; 611—Protrusion; 62—injection rod; 621—Pull handle; 63—First one-way control valve; 631—the first circulation hole; 632—Flexible pad; 633—baffle; 634—connecting rod; 635—free washer; 636—the second circulation switching hole; 637—the third flow conversion hole; 64—water inlet; 641—the third water inlet channel; 642—second one-way control valve; 65—Sealing cover; 651—through hole; 66—Gasket; 67—Support pad; 671—limit column; 672—Flow hole.

DETAILED DESCRIPTION

The present invention will be described in detail with reference to the attached drawings and examples. Various examples are provided by way of explanation of the invention without limiting the invention. In fact, it will be clear to those skilled in the art that modifications and variations can be made in the present invention without departing from its scope or spirit. For example, features shown or described as part of one embodiment may be used in another embodiment to yield yet another embodiment. Therefore, it is desired that the present invention include such modifications and variations as come within the scope of the appended claims and their equivalents.

In the description of the present invention, the terms "longitudinal", "transverse", "upper", "lower", "front", "rear", "left", "right", "vertical", "horizontal", "top" and "bottom" indicate the orientation or position relationship based on the attached drawings, and only the orientation or position relationship, and are intended only for the purpose of This is only for the purpose of describing the present invention and does not require that the present invention must be constructed and operated in a particular orientation, and therefore is not to be construed as a limitation of the present invention. The terms "connected", "connected", and "setup" as used in the present invention are to be understood in a broad sense, for example, it can be a fixed connection or a detachable connection; it can be a direct connection, or it can be connected through an intermediate part. For example, it can be a fixed connection or a detachable connection; it can be a direct connection or an indirect connection through an intermediate part; it can be a wired electric connection, a radio connection, or a wireless communication signal connection, and a person of ordinary skill in the art can understand the specific meaning of the above terms according to the specific circumstances.

One or more examples of the invention are shown in the attached drawings. Detailed Description Numeric and alphabetic symbols are used to refer to features in the drawings. Similar or similar symbols in the drawings and description have been used to refer to similar or similar parts of the present invention. As used herein, the terms "first", "second" and "third" are used interchangeably to distinguish one component from another and are not intended to indicate the position or importance of individual components.

As shown in FIGS. 1 to 20, according to the embodiment of the invention, a water balloon injection assembly is provided, including a connection part 1 that can be connected with an external water pipe or an external water injection barrel, a water injection seat 2 that is basically rectangular, and a conversion seat 3. The water injection barrel is a prior art, such as a water injection barrel in the form of a syringe principle and an air filled barrel, which will not be described here. The water injection seat 2 is provided with a plurality of water outlets 21, which are preferably arranged in rows, and at least one row, generally not more than five rows, preferably two to four rows. Each water outlet 21 is provided with an injection tube bundle 22 which is connected with the water outlet 21. The injection tube bundle is 4 cm-20 cm long and 1.5 mm-3 mm in diameter. When the water outlet is provided with two or more rows, the adjacent two water outlets are staggered instead of the previous radial radiation, so that the balloons between the adjacent two rows are staggered from front to back and from left to right after being filled with water, which can further reduce the expansion range, In this way, the length of the corresponding injection tube bundle 22 can be reduced and the processing cost of the injection tube bundle can be saved. Therefore, the length of the injection tube bundle 22 is preferably 4 cm-15 cm, and the diameter of the injection tube bundle 22 is 1.5 mm-2.5 mm. A balloon 23 is arranged on the injection tube bundle 22, and the balloon 23 is tied and fixed on the injection tube bundle 22 through a rubber ring. The conversion seat 3 has two opposite clamping slots 31, and the opening 32 area surrounded by the two clamping slots 31 has a structure of large inside and small outside. The shape of the water injection seat 2 is adapted to the opening area surrounded by the two clamping slots 31, so that the water injection seat 2 can be just inserted into the two clamping slots 31. When the water injection seat 2 is inserted into the two clamping slots 31, the small end of the opening 32 can be used for the injection tube bundle 22 to pass through. The connecting part 1 is provided with a first water inlet channel 11, and the connecting part 1 is integrally formed with the conversion seat 3. The first water inlet channel 11 is connected with the big end of the opening 32. The water flowing out of the first water inlet channel 11 is then injected into the inside of the balloon 23 through the water outlet 21 and the injection tube bundle 22 to realize balloon water injection. After the balloon is filled with water, only plug and replace the water injection seat 2, which eliminates the frequent and tedious disassembly of the external water pipe or water injection tube. The installation, disassembly and use are simple and practical. In this embodiment, the water injection seat 2 is basically rectangular. The water distribution chamber 24 on the water injection seat 2 is concave and can cover all the water outlets 21. The far water outlet 21 side of the water distribution chamber 24 is open, and the near water outlet 21 side is connected with the water outlet 21. The two opposite sides of the water injection seat 2 are provided with clamping edges 25, Therefore, the water flowing out of the first water inlet channel 11 needs to be evenly distributed through the water separation chamber 24 before being injected into the corresponding balloon through the respective water outlet 21 to ensure that the balloon is filled evenly.

Figure 3:
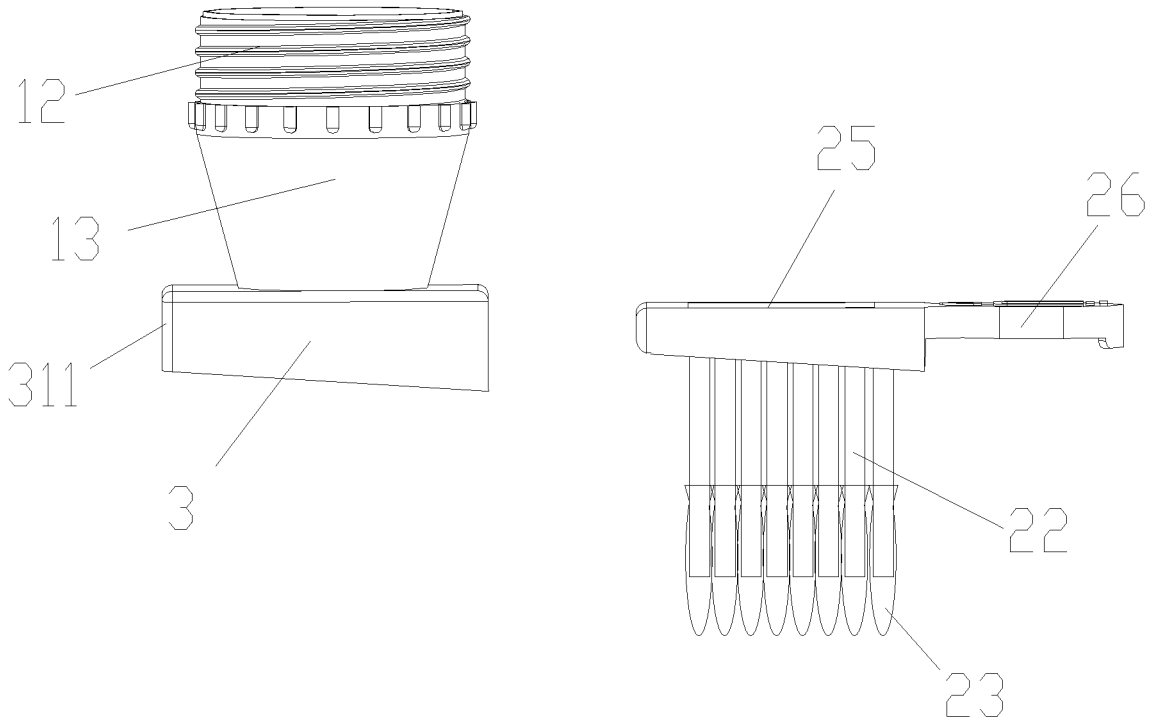
FIG. 3 is a schematic diagram of the exploded front view structure of an embodiment of the water polo water injection assembly (excluding the conversion head)
Figure 4:
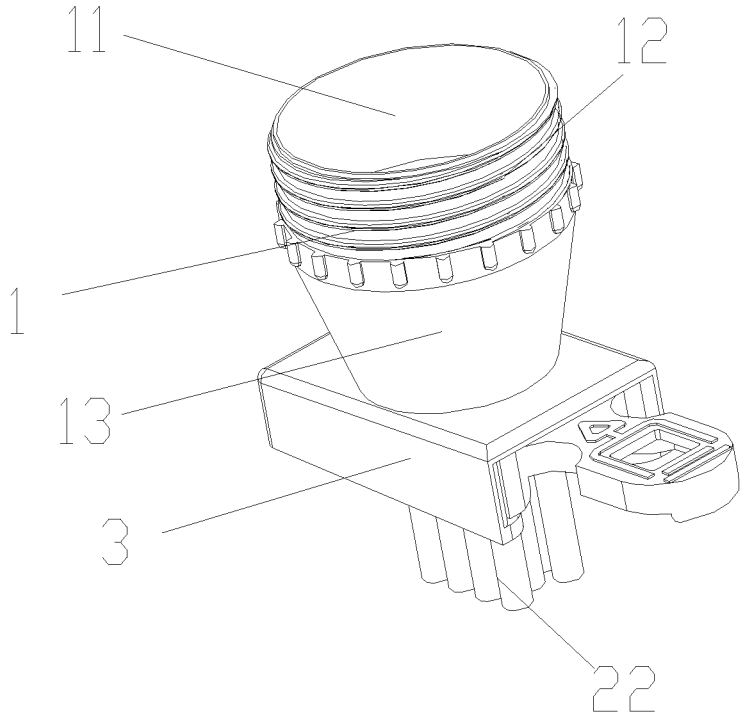
FIG. 4 is a schematic diagram of the assembled state of an embodiment of the water polo water injection assembly (excluding the balloon and the conversion head)
Figure 5:
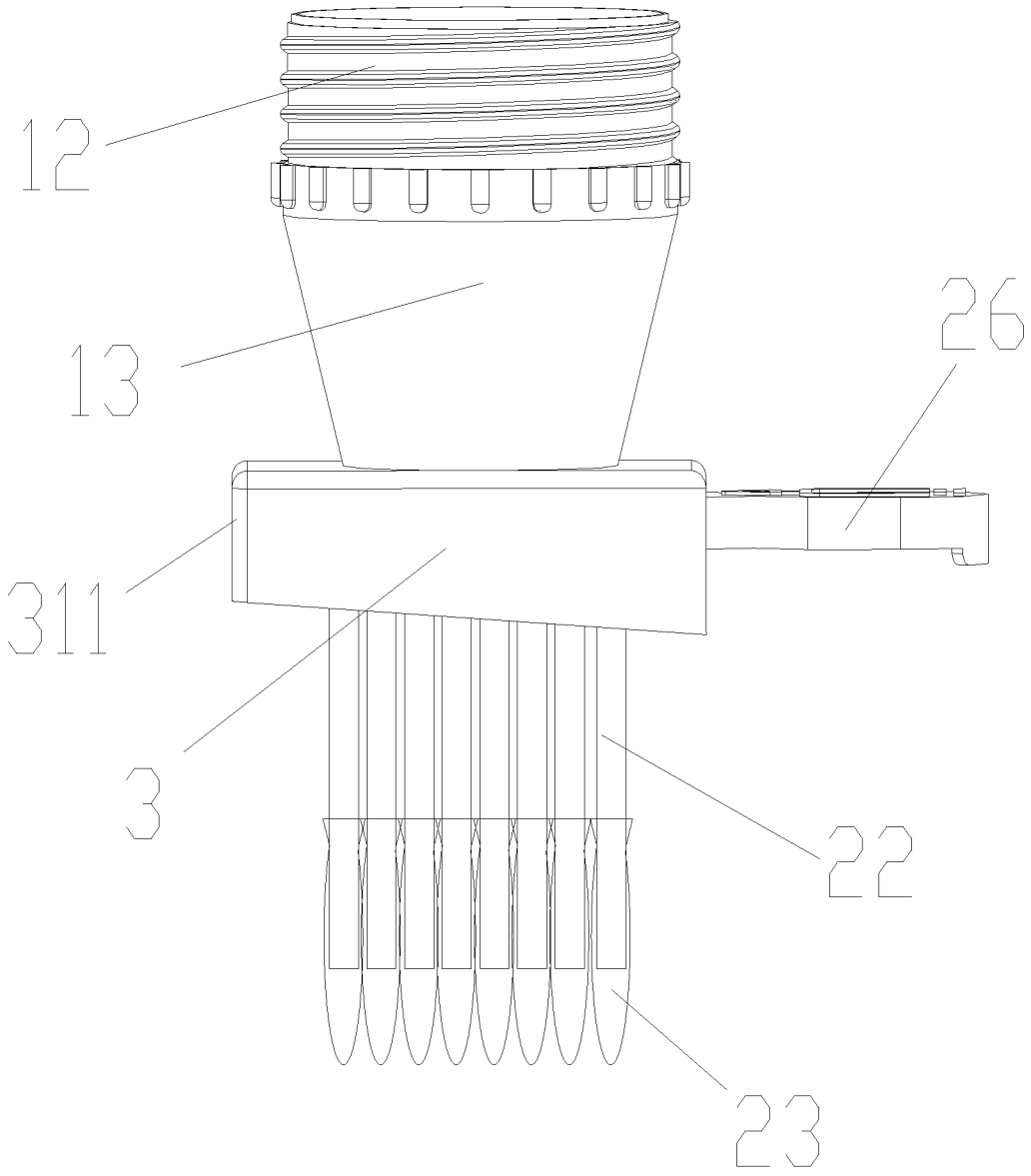
FIG. 5 is a schematic diagram of the combined state of the main view structure of an embodiment of the present water balloon injection assembly (excluding the conversion head)

When the water injection seat 2 is inserted into the two clamping grooves 31, the area surrounded by the two clamping grooves 31 can cover the water diversion cavity 24, so that the two clamping grooves 31 can naturally close the water diversion cavity 24, and the water injection seat 2 and the two clamping grooves 31 are in transition fit or interference fit, so that water will not overflow from the joint between the water injection seat 2 and the two clamping grooves 31. Furthermore, the sealing surface 311 is arranged on the same side of the two clamping grooves 31, and the big ends of the openings 32 of the two clamping grooves 31 have a wedge-shaped tendency to gradually narrow from the far sealing surface 311 side to the near sealing surface 311 side, so that the water injection seat 2 has a gradual tightening effect when being inserted into the two clamping grooves 31, so that the connection between the water injection seat 2 and the two clamping grooves 31 is more compact, and water is ensured not to overflow from the joint between the water injection seat 2 and the conversion seat 3. One side of the other two opposite sides of the water injection seat 2 is provided with a hand-held part 26, which is convenient for subsequent plugging and unplugging of the water injection seat 2. The hand-held part 26 includes a handle 261. Further, as shown in FIG. 3, the thickness of the water injection seat 2 can be set to have a wedge-shaped trend of gradually narrowing from the side near the hand-held part 26 to the side far from the hand-held part 26, so as to further ensure the tight connection between the water injection seat 2 and the two clamping grooves 31 and ensure that water will not overflow from the connection between the water injection seat 2 and the two clamping grooves 31. The setting of the sealing surface 311 enables the operator to quickly distinguish the insertable direction of the clamping groove 31, and the operation is more convenient.

In a preferred embodiment, the connecting part 1 has a first threaded part 12. The thread connection between that connecting part 1 and an external water pipe or an external water injection cylinder is realized through the first threaded part 12, so that water can be injected into the balloon through the first water inlet channel 11, the water diversion cavity 24, the water outlet hole 21 and the injection tube bundle 22. Furthermore, the first water inlet channel 11 has a funnel-shaped connecting channel 13, which is arranged between the first threaded part 12 and two opposite clamping grooves 31, so that it is easier to process and shape, and can adapt to the rapid connection with external hoses (or hoses with different sizes, especially thin hoses with diameters smaller than the first threaded part 12), which is more practical and extremely convenient to operate.

Figure 6:
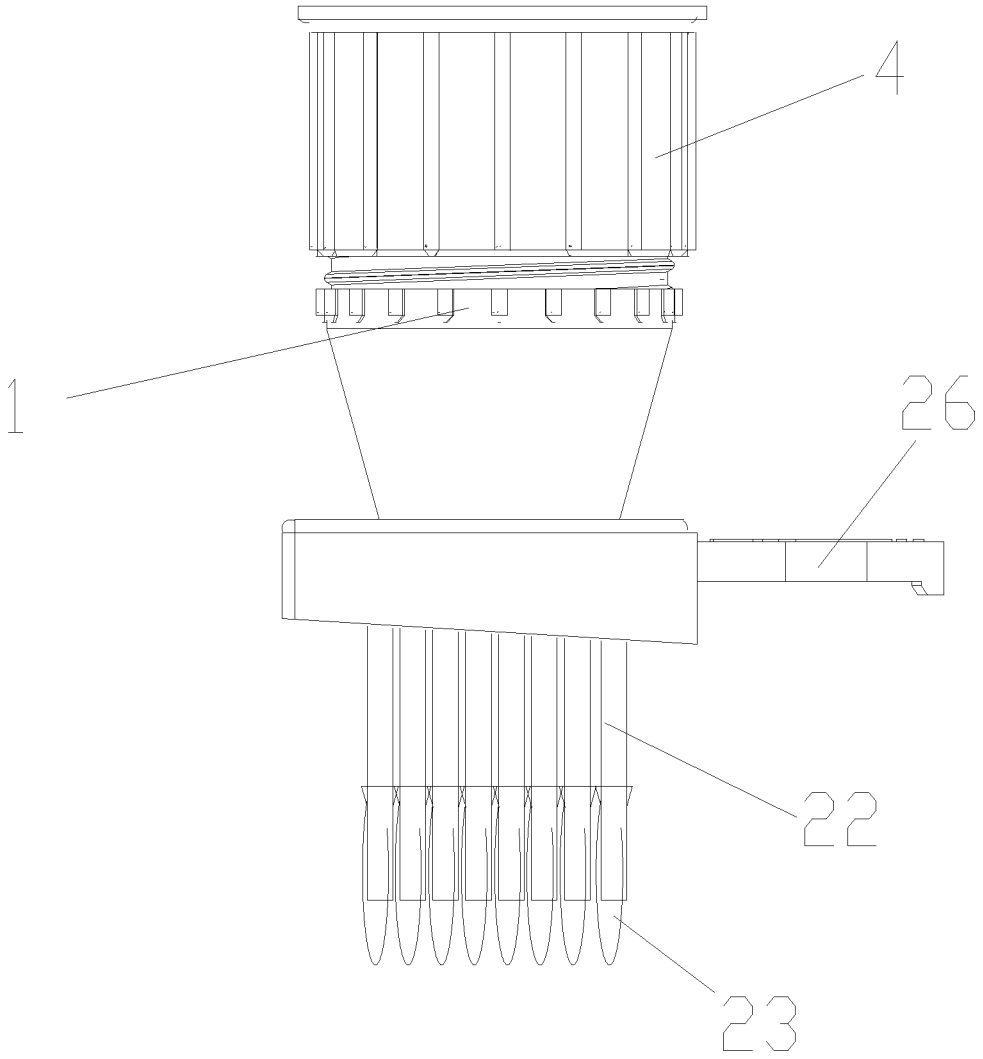
FIG. 6 is a schematic diagram of the combined state of the main view structure of an embodiment of this water balloon injection assembly.
Figure 7:
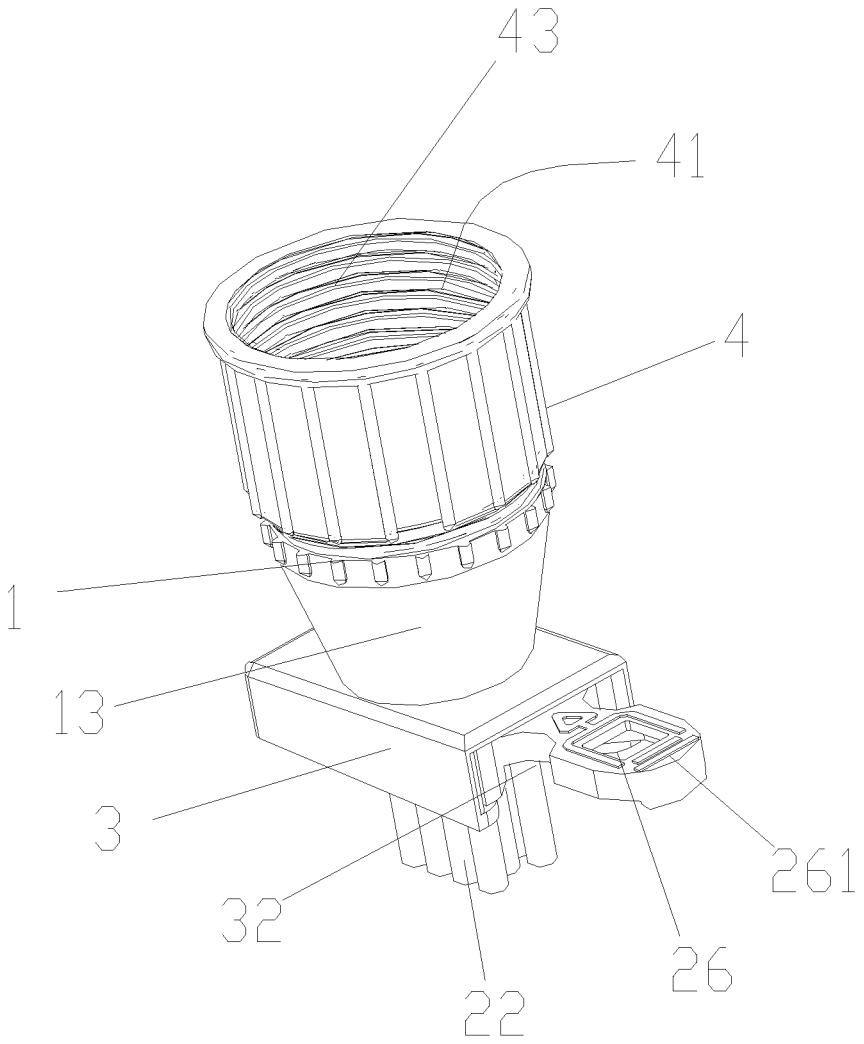
FIG. 7 is a schematic diagram of the combined state of an embodiment of this water balloon injection assembly (omitting the balloon)

In a preferred embodiment, as shown in FIGS. 6 to 7, the water balloon water injection assembly also includes a conversion head 4, the conversion head 4 has a conversion channel 41, and the lower section of the inner wall of the conversion head 4 is provided with a second threaded section 42 that cooperates with the first threaded section 12, so that when the connection section 1 is threaded through the first threaded section 12 and the second threaded section, the conversion channel 41 is connected with the first water inlet channel 11; the upper section of the inner wall of the conversion head 4 is provided with a third threaded section 43, which is used to connect with an external water injection cylinder or water pipe. The upper part of the inner wall of the conversion head 4 is provided with a third threaded part 43, which is used to connect with the external water injection cylinder or water pipe. In this way, when facing a water pipe with non-standard threads or an external water cylinder with non-standard threads, the third threaded portion 43 of the conversion head 4 is used to realize the connection between the connection section 1 and a water pipe with non-standard threads or an external water cylinder with non-standard threads by setting up the conversion head 4 and threading the conversion head 4 to the first threaded portion 12 of the connection section 1 to further expand the scope of application.

Figure 8:
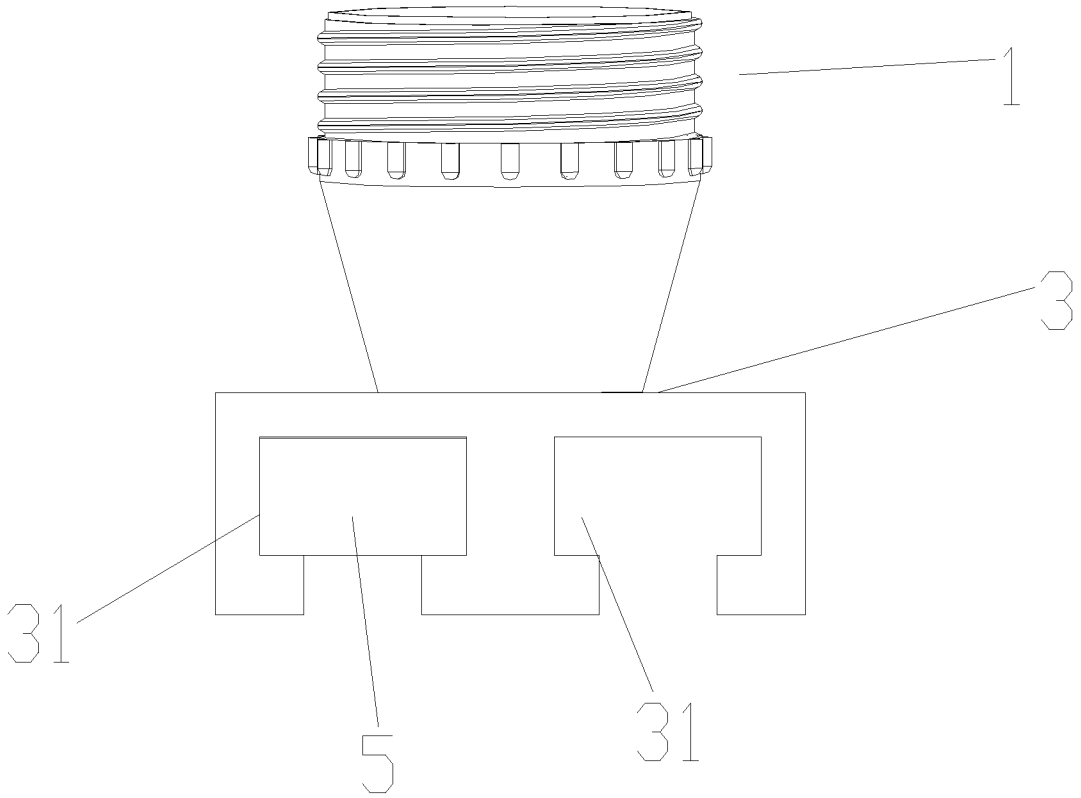
FIG. 8 is a schematic diagram of the conversion seat (two groups of clamping grooves) in an embodiment of the water polo water injection assembly.

In a preferred embodiment, as shown in FIG. 8, in order to further increase the number of water balloons to be filled with water at a single time, there are two or more sets of snap-in slots 31, each set of snap-in slots 31 is set side by side or in an axial array and is integrally molded with the connecting part. This can be simultaneously on a plurality of water injection seat 2 on a plurality of groups of balloons for water injection, and further improve the speed of balloon water injection. Further, the water balloon filling assembly also includes a water sealing plug 5, the shape of the water sealing plug 5 is adapted to the area surrounded by the two joint grooves 31, and the water sealing plug 5 can be inserted exactly into the two joint grooves 31. In this way, when the water flow, water pressure is small or need to inject water balloon less, the water sealing plug 5 will be inserted into one group of card joint slot 31 or two groups of card joint slot 31, you can adjust the number of single injection of water balloon as well as by the water outlet 21, the injection tube bundle 22 injected into the balloon of the water pressure, to ensure that the effect of the balloon water filling, the water pressure requirements of low.

In the above technical scheme, the first threaded part 12 is screwed on an external water pipe or an external water injection cylinder; Or plug the funnel-shaped connecting channel 13 into the external hose. Only by inserting the water injection seat 2 into the two opposite clamping grooves 31, the water diversion cavity 24 can be connected with the first water inlet channel 11, and the opening area surrounded by the two clamping grooves 31 covers the water diversion cavity 24 to realize the sealed connection between the conversion seat 3 and the water injection seat 2, so that water can be injected into the balloon 23 through the first water inlet channel 11, the water outlet hole 21 and the injection tube bundle 22. After the balloon is filled with water, the water injection seat 2 is pulled out of the two clamping grooves 31 by holding the hand-held part 26, and the water polo can be separated from the injection tube bundle by shaking it by hand, which is very convenient to use and even in water filling. The replacement of the water injection seat 2 and the convenient connection with the conversion seat 3 can be realized only by plugging and unplugging the water injection seat 2, and the utility model has strong practicability and extremely convenient operation.

Figure 9:
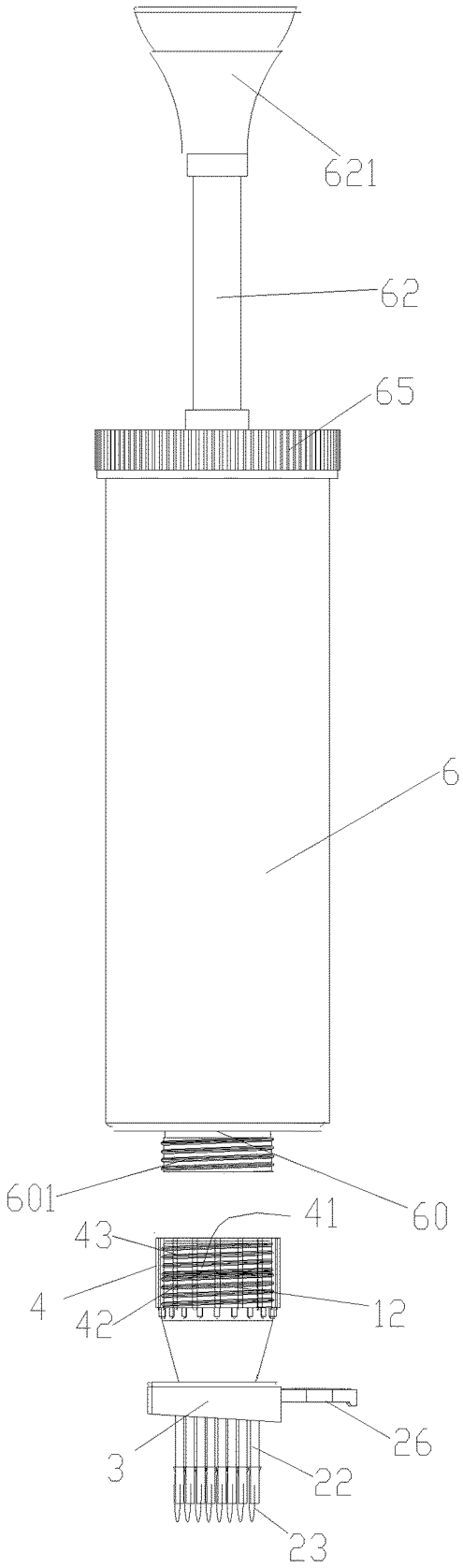
FIG. 9 is a schematic diagram of an embodiment of the water polo water injection device in an exploded state.

The invention also discloses a water polo water injection device, which comprises a water injection cylinder 6 and a water polo water injection component, and the water outlet end of the water injection cylinder 6 is connected with the water polo water injection component. The cross section of the cylinder of the water injection cylinder 6 is preferably circular, and an injection head 61 which can slide up and down is arranged in the cylinder of the water injection cylinder 6, and the injection head 61 is connected with an injection rod 62 which protrudes out of the cylinder of the water injection cylinder 6 and is hermetically connected with the cylinder of the water injection cylinder 6 through a gasket 66; A water outlet 60 is arranged on the far side of the injection rod 62 of the water injection cylinder 6, and the water outlet 60 is connected with the water polo water injection assembly. The joint between the water injection cylinder 6 and the water polo water injection assembly can be integrally injection molded or detachably connected; When the water injection cylinder 6 is detachably connected with the water polo water injection assembly, the connection mode can be threaded connection, clamping or interference fit. As shown in FIG. 9, a fourth threaded part 601 is arranged outside the water outlet 60, and the fourth threaded part 601 is matched with the third threaded part 43 of the changeover head 4, so that the water injection cylinder 6 and the water polo water injection assembly are connected through the changeover head 4.

Figure 10:
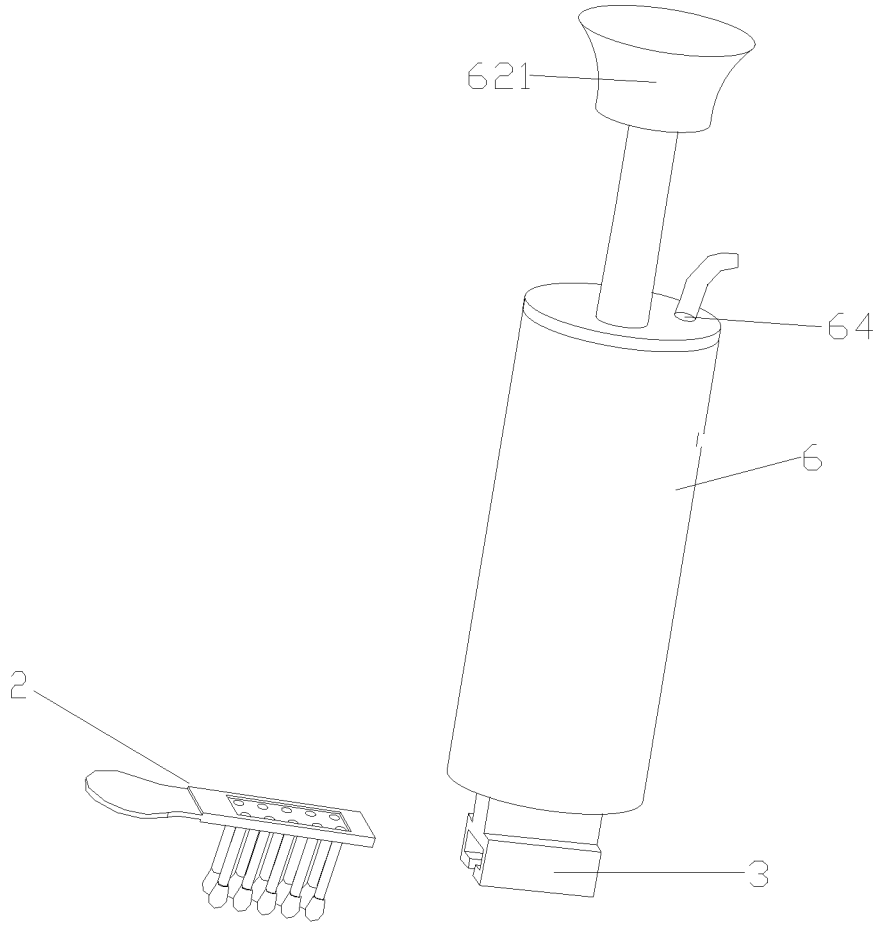
FIG. 10 is an exploded view of another embodiment of the water polo water injection device.
Figure 11:
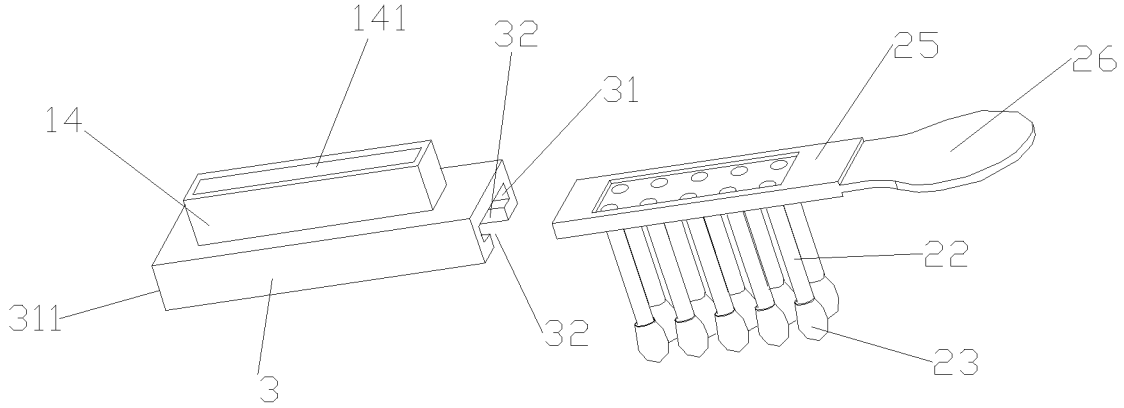
FIG. 11 is a schematic diagram of a water injection seat and a connector according to an embodiment.
Figure 12:
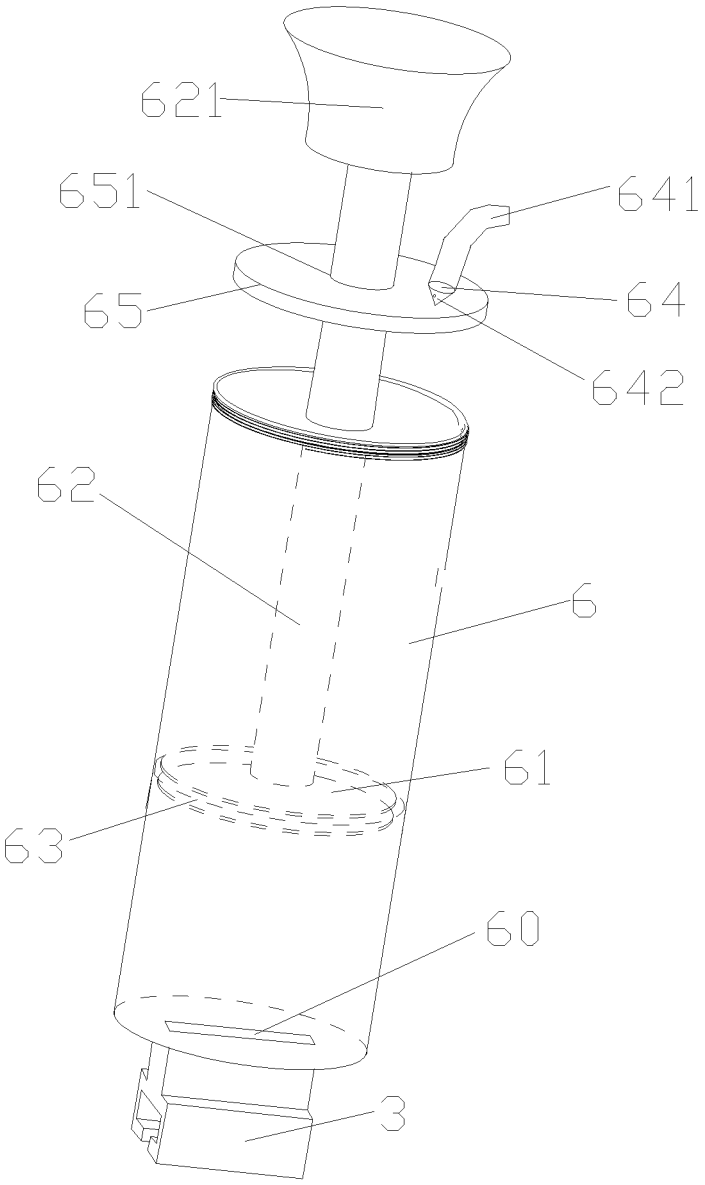
FIG. 12 is a schematic diagram of the exploded state of the water polo water injection device (excluding the water injection seat)

In a preferred embodiment, as shown in FIG. 10, the water injection cylinder 6 and the conversion seat 3 are set up as a one-piece type, the water outlet 60 of the water injection cylinder 6 is set up with a connector 14, the connector 14 is set up with a second water inlet channel 141, the connector 14 is integrally molded with the conversion seat 3, as shown in FIG. 11, the second water inlet channel 141 is connected with the large end of the opening 32, when the water injection seat 2 is connected to the conversion seat 3 through the snap-in slot 31, the water flowing out of the second water inlet channel 141 is then injected into the balloon 23 through the water distribution chamber 24, the water outlet hole 21, and the injection tube bundle 22, realizing the water injection of the balloon 23.

The injection head 61 divides the water injection cylinder 6 into two parts, pushes the injection rod 62 to move the injection head 61 from top to bottom, and the lower part of the water injection cylinder 6 is compressed to pressurize the water in the lower part of the water injection cylinder 6, and the water is injected into the balloon 23 through the water outlet 60, the connector 14, the water outlet 21 and the injection tube bundle 22. The injection head 61 is provided with a first one-way control valve 63, and the first one-way control valve 63 only allows water in the water injection cylinder 6 to flow from the cylinder on the injection rod 62 side to the cylinder on the far injection rod 62 side through the first one-way control valve 63.

A sealing cover 65 is arranged at the far water outlet 60 side of the water injection cylinder 6, and the sealing cover 65 is arranged on the water injection cylinder 6 through threaded connection or interference fit between the sealing cover 65 and the water injection cylinder 6, and a through hole 651 for the injection rod 62 to move up and down is arranged on the sealing cover 65, and the injection rod 62 passes through the through hole 651 and moves up and down in the through hole 651, and a water inlet 64 is arranged at the far water outlet 60 side of the water injection cylinder 6 or on the sealing cover 65. The water inlet 64 is provided with a third water inlet channel 641, which is connected with a container for storing water through a flexible pipe (not shown in the attached figure), and the third water inlet channel 641 can be in a straight line or an L-shape. The water inlet 64 is preferably arranged on the sealing cover 65, which is convenient for loading and subsequent drawing of the injection head 61. The injection rod 62 is hermetically connected with the sealing cover 65 through a gasket 66 to prevent the water in the water injection cylinder 6 from overflowing to the outside. The gasket 66 can also be replaced by a sealing ring to realize the sealed connection between the injection rod 62 and the sealing cover 65, which will not be described in detail here.

In a preferred embodiment, the water inlet 64 is provided with a second one-way control valve 642 which only allows water to flow from the outside of the water injection cylinder 6 to the inside of the water injection cylinder 6. The second one-way control valve 642 can be a common duckbill check valve or a flexible rubber pad. When the second one-way control valve 642 is a flexible rubber pad, the flexible rubber pad can cover the water inlet 64. At this time, the sealing gasket 66 and the second one-way control valve 642 can be separately arranged on the sealing cover 65, or the size of the sealing gasket 66 can be increased, so that part of the sealing gasket 66 acts as the second one-way control valve 642 to cover the water inlet 64. When the sealing gasket 66 acts as the second one-way control valve 642, a support pad 67 is penetrated on the injection rod 62. The support pad 67 can slide up and down on the injection rod 62 and is arranged below the sealing pad 66. The support pad 67 can cover the sealing pad 66 and is provided with a limit post 671, which penetrates the injection rod 62 and abuts against the sealing pad 66, so that the sealing pad 66 always abuts against the sealing cover 65, the injection rod 62 always keeps sealing with the sealing cover 65, the sealing pad 66 always stays at the water inlet 64 and the support pad 67 and the sealing pad 66 always abut against the sealing pad 66. The support pad 67 is provided with a circulation hole 672, so that when the injection rod 62 is pushed downward, the upper space of the water injection cylinder 6 gradually increases to form a negative pressure, so that the gasket 66 opens the water inlet 64, and external water flows into the water injection cylinder 6 from the water inlet 64 through the circulation hole 672, so that water can be filled into the water injection cylinder 6 while the balloon is filled with water. When the injection rod 62 drives the injection head 61 to move from bottom to top, a negative pressure is formed at the lower part of the water injection cylinder 6, and the water at the upper part of the water injection cylinder 6 flows from the injection rod 62 side to the far injection rod 62 side through the first one-way control valve 63 to fill the lower part of the water injection cylinder 6. At this time, the gasket 66 is pressed against the sealing cover 65 under the water pressure to seal the water inlet 64, so that a closed circulation system is formed inside the water injection cylinder 6 to prevent water from flowing from the inside of the water injection cylinder 6 to the outside of the water injection cylinder 6.

When the injection rod 62 drives the injection head 61 to move from top to bottom, at this time, the upper space of the water injection cylinder 6 gradually increases to form negative pressure, so that external water flows into the water injection cylinder 6 from the water inlet 64, and water is filled in the water injection cylinder 6 at the same time. When the injection rod 62 drives the injection head 61 to move from bottom to top, a negative pressure is formed in the lower space of the water injection cylinder 6, and the water in the upper space of the water injection cylinder 6 flows from the injection rod 62 side to the far injection rod 62 side through the first one-way control valve 63 to fill the lower space of the water injection cylinder 6, thus realizing continuous water extraction and pressurized injection into the balloon, and further realizing continuous water injection of water polo.

Specifically, there may be various embodiments of the first one-way control valve 63.

Figure 13:
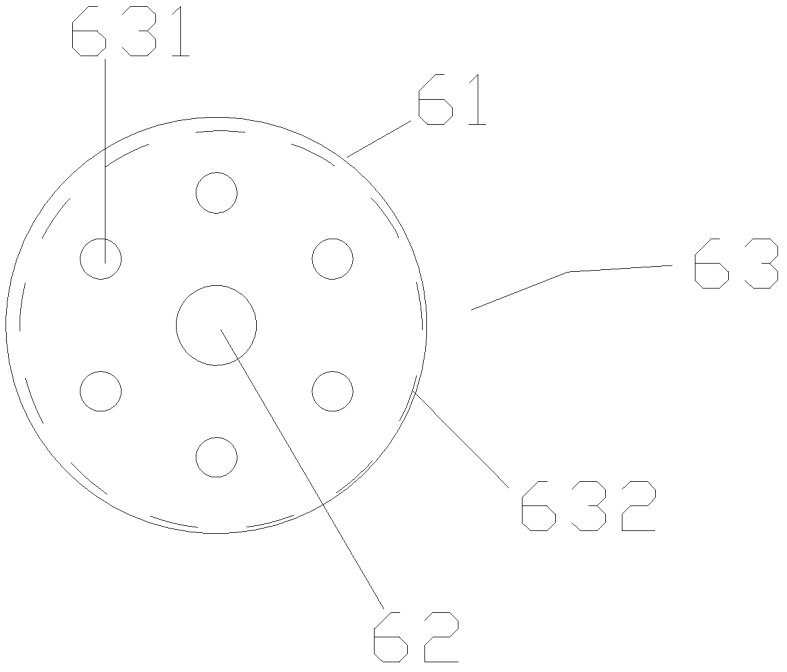
FIG. 13 shows a schematic diagram of the top view structure of a first embodiment of the first one-way control valve.
Figure 14:
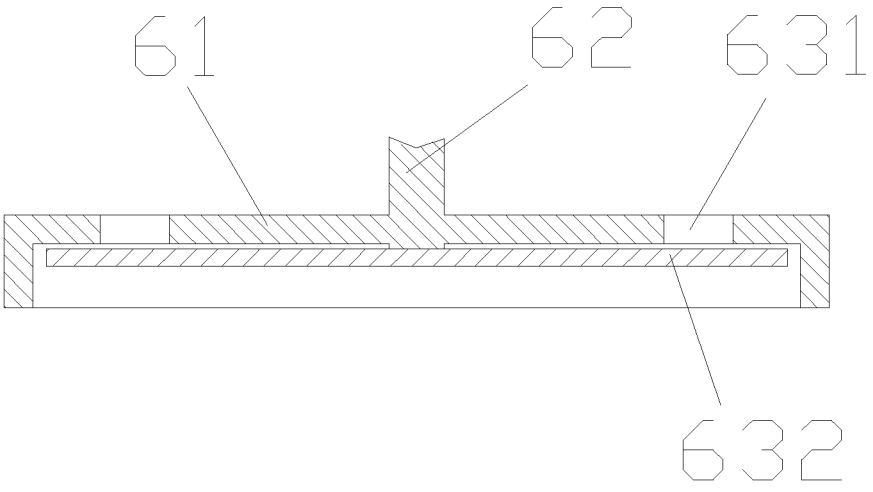
FIG. 14 shows a schematic diagram of the main view sectional structure of the first embodiment of the first one-way control valve.

In one embodiment, as shown in FIGS. 13 to 14, the first one-way control valve 63 includes a first circulation hole 631 penetrating the injection head 61 and a flexible pad 632, which is arranged far from the injection rod 62 and can cover the first circulation hole 631, and the first circulation hole 631 is arranged in an eccentric or annular array on the injection head 61, so that when the injection rod 62 is pushed to move the injection head 61 from top to bottom, the injection head 61 pushes the flexible pad 632. At this time, the flexible pad 632 is attached to the injection head 61 and covers the first circulation hole 631 to prevent the water in the water injection cylinder 6 from flowing from the far injection rod 62 side to the injection rod 62 side. When the injection head 61 moves from bottom to top, the flexible pad 632 is flexibly deformed under the negative pressure of the barrel on the far side of the injection rod 62 and the water pressure of the barrel on the far side of the injection rod 62, so that the flexible pad 632 peels off the injection head 61, so that the water in the water injection barrel 6 flows from the side of the injection rod 62 to the far side of the injection rod 62 through the first one-way control valve 63.

Figure 15:
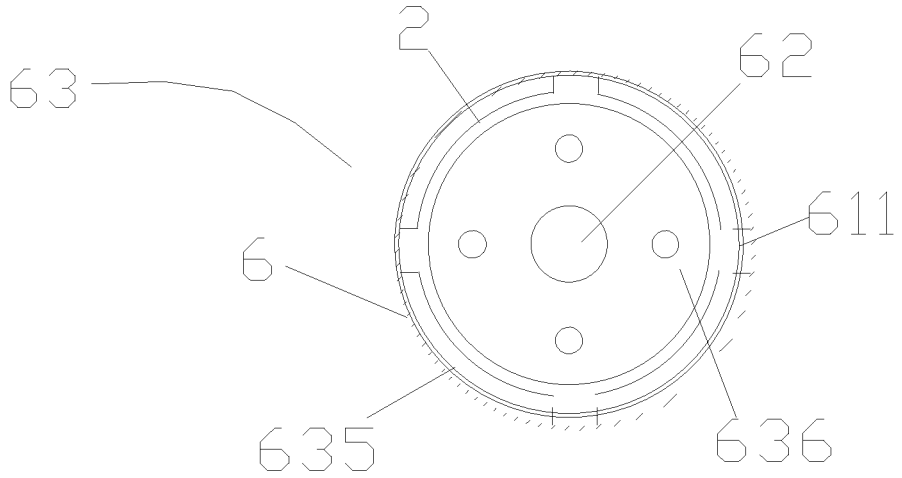
FIG. 15 is a schematic top view of the second embodiment of the first one-way control valve.
Figure 16:
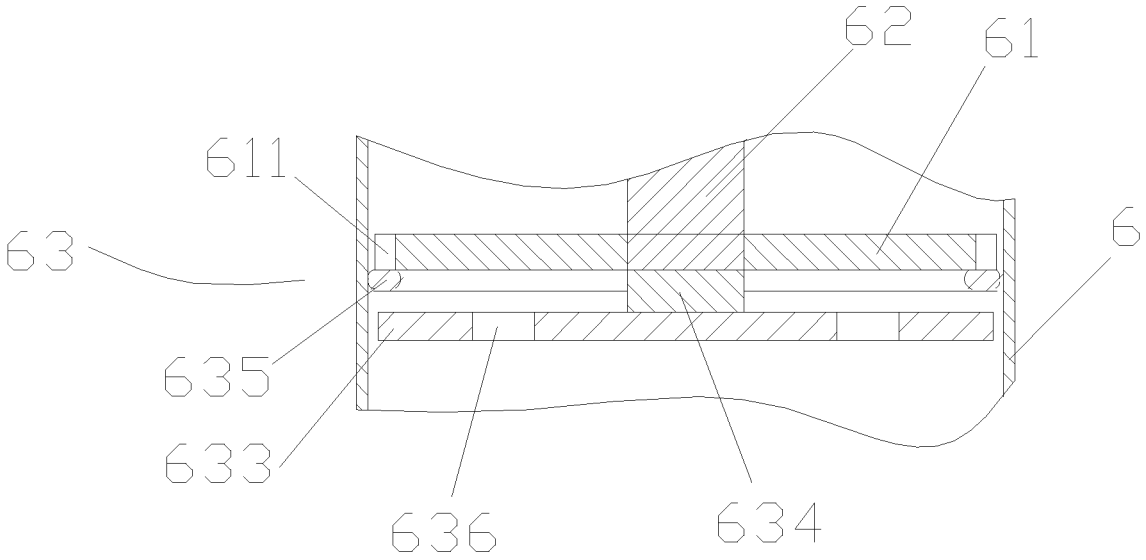
FIG. 16 shows a schematic diagram of the main view sectional structure (injection head moving state from top to bottom) of the second embodiment of the first one-way control valve.
Figure 17:
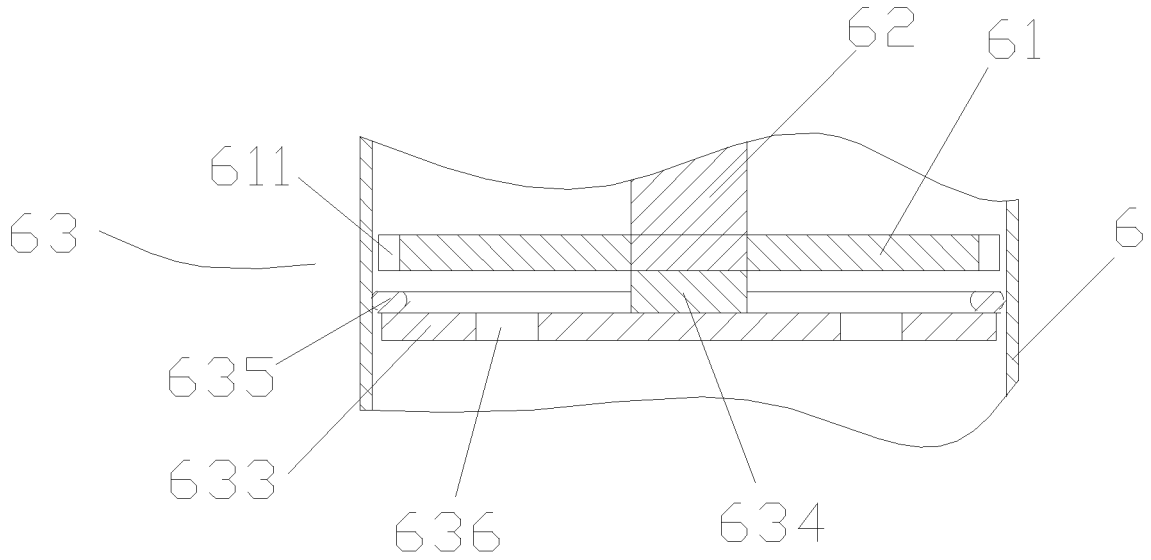
FIG. 17 shows a schematic diagram of the main view sectional structure (injection head moving state from bottom to top) of the second embodiment of the first one-way control valve.
Figure 18:
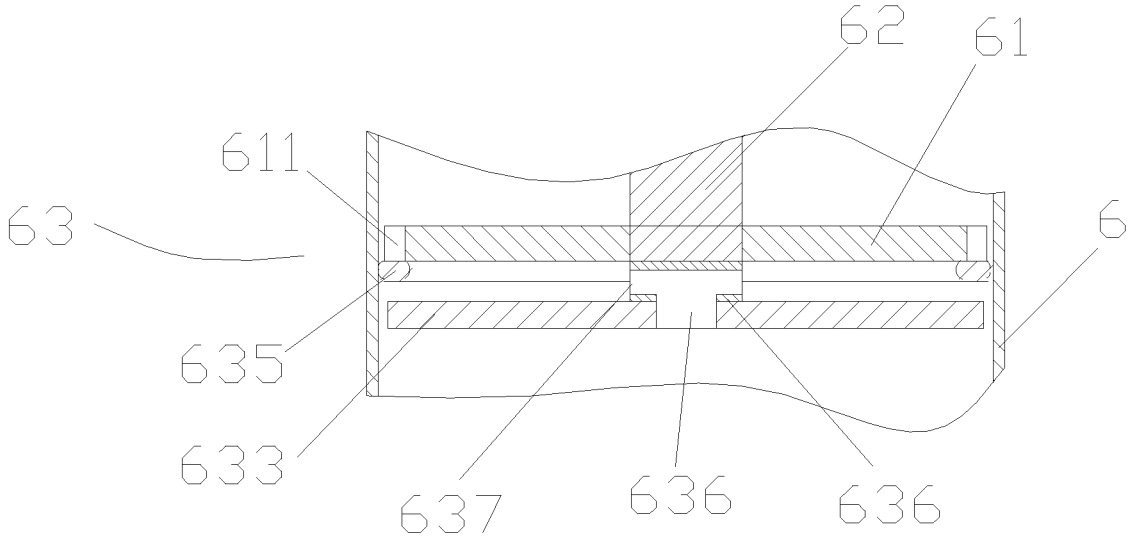
FIG. 18 shows a schematic diagram of the main view sectional structure (injection head moving state from top to bottom) of the third embodiment of the first one-way control valve.
Figure 19:
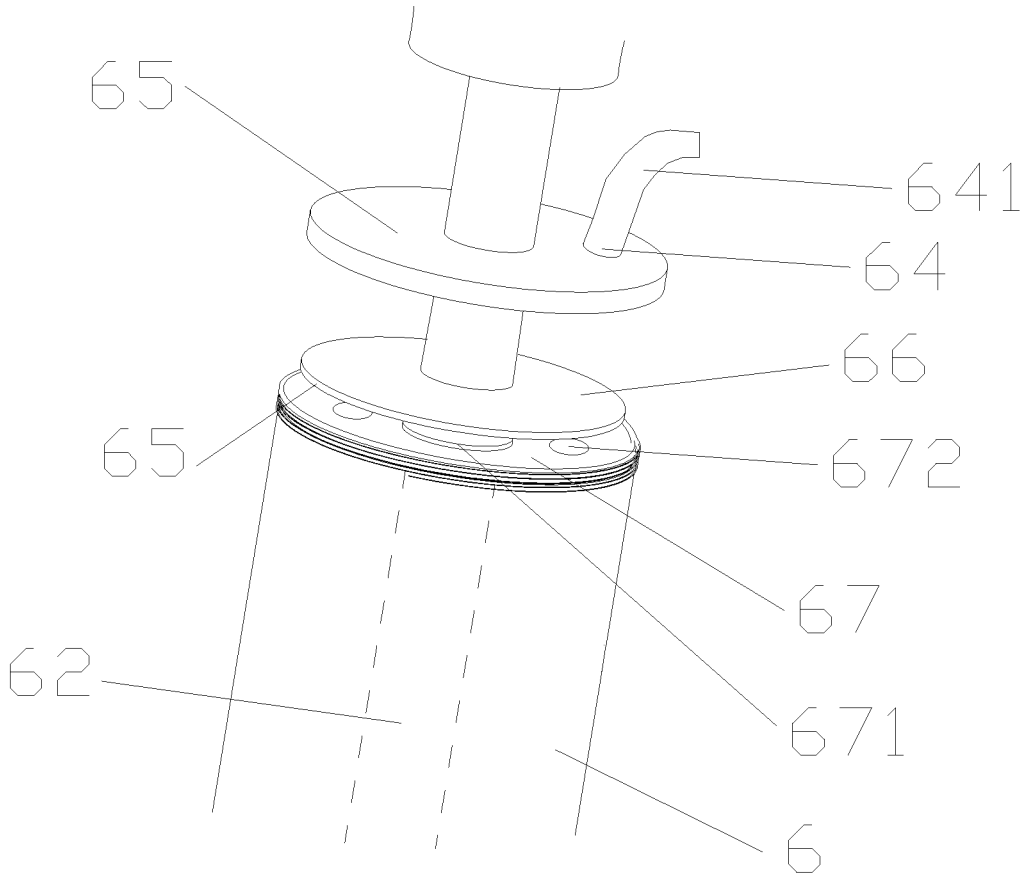
FIG. 19 is a schematic diagram of the exploded state of the second one-way control valve in an embodiment of the water polo water injection device.
Figure 20:
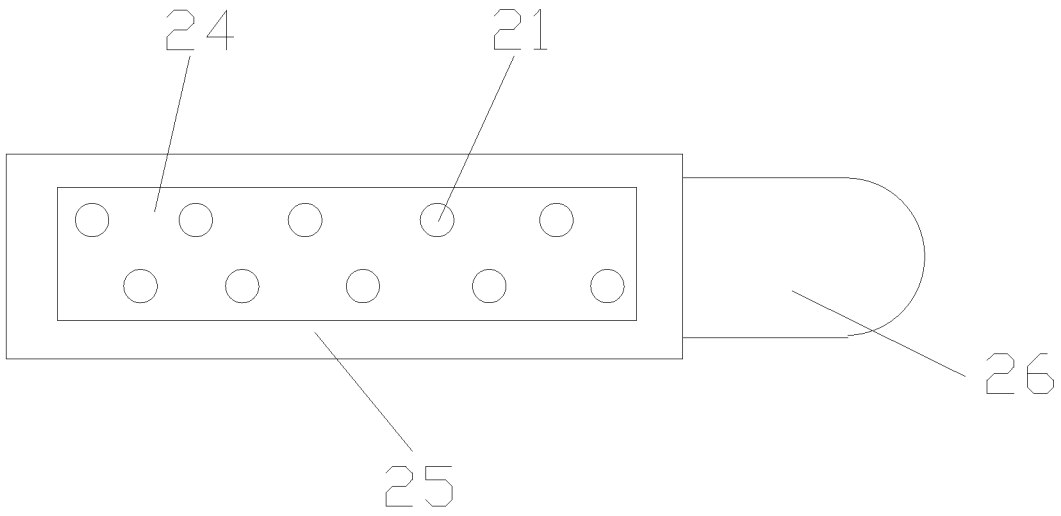
FIG. 20 is a schematic diagram of the top view structure of the water injection seat.

Alternatively, in one embodiment, as shown in FIGS. 15 to 17, the first one-way control valve 63 includes a baffle 633 adapted to the inner wall of the water injection cylinder 6. The baffle 633 is connected with the injection head 61 through a connecting rod 634 and can slide up and down together with the injection head 61. A free washer 635 is provided between the baffle 633 and the injection head 61, and the free washer 635 can freely move up and down between the baffle 633 and the injection head 61. The outer diameter of the free washer 635 is larger than the inner diameter of the water injection cylinder 6 and the inner diameter of the free washer 635 is smaller than that of the injection head 61. The diameter of the injection head 61 is in clearance fit with the inner wall of the water injection cylinder 6, so that water can enter the area between the free washer 635 and the injection head 61 from the clearance. A plurality of protrusions 611 are arranged at the edge of the injection head 61, which are in coordination with the inner wall of the water injection cylinder 6, so as to increase the gap between the injection head 61 and the inner wall of the water injection cylinder 6 and prevent the injection head 61 from shaking. The baffle plate 633 is provided with a second circulation conversion hole 636, which can be of a hole type or a slit type. As shown in FIG. 18, a third circulation conversion hole 637 can be further provided on the connecting rod 634, and the second circulation conversion hole 636 is connected with the third circulation conversion hole 637, so that when the injection rod 62 is pushed to move the injection head 61 from top to bottom, Friction between the free washer 635 and the inner wall of the water injection cylinder 6 makes the free washer 635 lean against the injection head 61 to seal the gap between the injection head 61 and the inner wall of the water injection cylinder 6, and prevents the water in the water injection cylinder 6 from flowing from the far injection rod 62 side to the injection rod 62 side. When the injection head 61 moves from bottom to top, the friction between the free washer 635 and the inner wall of the water injection cylinder 6 causes the free washer 635 to lean against the baffle plate 633, so that the water on the injection rod 62 side in the water injection cylinder 6 can enter the area between the free washer 635 and the injection head 61 from the above gap and then flow to the far injection rod 62 side through the second circulation switching hole 636 or the third circulation switching hole 637 and then through the second circulation switching hole 636 to realize continuous water extraction and pressurized injection.

Cylinder 6 and prevent the injection head 61 from shaking. The baffle plate 633 is provided with a second circulation conversion hole 636, which can be of a hole type or a slit type. As shown in FIG. 18, a third circulation conversion hole 637 can be further provided on the connecting rod 634, and the second circulation conversion hole 636 is connected with the third circulation conversion hole 637, so that when the injection rod 62 is pushed to move the injection head 61 from top to bottom, Friction between the free washer 635 and the inner wall of the water injection cylinder 6 makes the free washer 635 lean against the injection head 61 to seal the gap between the injection head 61 and the inner wall of the water injection cylinder 6, and prevents the water in the water injection cylinder 6 from flowing from the far injection rod 62 side to the injection rod 62 side. When the injection head 61 moves from bottom to top, the friction between the free washer 635 and the inner wall of the water injection cylinder 6 causes the free washer 635 to lean against the baffle plate 633, so that the water on the injection rod 62 side in the water injection cylinder 6 can enter the area between the free washer 635 and the injection head 61 from the above gap and then flow to the far injection rod 62 side through the second circulation switching hole 636 or the third circulation switching hole 637 and then through the second circulation switching hole 636 to realize continuous water extraction and pressurized injection.

In the above technical scheme, only one end of the flexible pipe is inserted into the third water inlet channel 641, and the other end is connected with the container for storing water, and then the water injection seat 2 is inserted into the two clamping grooves 31, and then the pulling handle 621 arranged at the end of the injection rod 62 is repeatedly pulled up and down, so that continuous water extraction and pressurized injection can be realized, and water polo injection can be realized. After the balloon is filled with water, the water injection seat 2 is pulled out of the two clamping grooves 31 by holding the handle 95, and the water polo can be separated from the injection tube bundle 22 by shaking it by hand, so that the use is very convenient and the water polo is filled evenly.

What has been described above is only the preferred embodiment of the present invention, and it is not used to limit the present invention. For those skilled in the art, the present invention may have various modifications and changes. Any modification, equivalent substitution, improvement, etc. made within the spirit and principle of the invention should be included in the protection scope of the invention.

What is claimed is:

1. A water injection assembly for water balloons, comprising:

a connecting part provided with a first water inlet channel configured to be connected with an external water pipe or an external water injection cylinder;

a water injection seat, provided with a plurality of outlet holes and an injection tube bundle including a plurality of injection tubes communicating with the plurality of outlet holes;

a conversion seat, provided with two opposite clamping grooves, a shape of the water injection seat being adapted to an area of an opening surrounded by the two clamping grooves, and the water injection seat being capable of being just inserted into the two clamping grooves;

wherein the area of the opening enclosed by the two clamping grooves has a structure in which opposed ridges act to hold the water injection seat in place while providing a narrower opening for the injection tubes to pass through; a small end of the opening is capable of being used for the injection tube bundle to pass through; the first water inlet channel is connected to a large end of the opening; when the water injection seat is inserted into the two clamping grooves, a water flowing out of the first water inlet channel flows into the injection tube bundle through the outlet hole.

2. The water injection assembly according to claim 1, wherein said connecting part has a first threaded part.

3. The water injection assembly according to claim 1, wherein when there are two to five rows of water outlet holes, two adjacent rows of water outlet holes are staggered, a length of the injection tube bundle is 4 cm-15 cm, and a diameter of the injection tube bundle is 1.5 mm-2.5 mm.

4. The water injection assembly according to claim 1, wherein a limiting surface is arranged on a same side of the two clamping grooves.

5. The water injection assembly according to claim 1, wherein a balloon is arranged on the injection tube bundle, and when the water injection seat is inserted into the two clamping grooves, the water flowing out from the first water inlet channel is injected into the balloon through the water outlet hole and the injection tube bundle.

6. The water injection assembly according to claim 1, wherein the first water inlet channel has a funnel-shaped connecting channel which is arranged between the connecting part and two opposite clamping grooves.

7. The water injection assembly according to claim 6, further comprising a conversion head, wherein the conversion head has a conversion channel, an upper section of an inner wall of the conversion head is provided with a third threaded portion, and a lower section of the inner wall of the conversion head is provided with a second threaded portion that matches the first threaded portion; when the connecting portion passes through the first threaded portion and the second threaded portion is threaded to first threaded portion, the conversion channel is connected to the first inlet channel.

8. The water injection assembly according to claim 1, wherein said water outlet holes are provided in at least one row, and in said water injection seat there is provided a water dividing chamber which is concave and communicates with the water outlet holes, a far side of said water dividing chamber is open, a near side of the water dividing chamber is connected to the water outlet holes, and there is provided a snap-in edge on two opposing sides of the water injection seat; the two opposite sides of the water injection seat are provided with a catching edge.

9. The water injection assembly according to claim 8, wherein the connecting part and the conversion seat are integrally formed, the water outlet is provided with one to five rows, a length of the injection tube bundle is 4 cm-20 cm, and a diameter of the injection tube bundle is 1.5 mm-3 mm.

10. The water injection assembly according to claim 8, wherein the water injection seat is basically rectangular.

11. The water injection assembly according to claim 1, wherein the water injection seat is provided with a hand-held part.

12. The water injection assembly according to claim 11, wherein a thickness of the water injection seat has a wedge-shaped tendency to gradually narrow from a near hand-held part side to a far hand-held part side, and open big ends of the two clamping grooves have a wedge-shaped tendency to gradually narrow from a far limit surface side to a near limit surface side.

13. The water injection assembly according to claim 11, wherein the clamping grooves are provided with two or more groups, and each group of clamping grooves is arranged in parallel or in axial array and integrally formed with the connecting part.

14. The water injection assembly according to claim 13, further comprising a water sealing plug, wherein a shape of the water sealing plug is adapted to the area surrounded by the two clamping grooves, and the water sealing plug is capable of being inserted just inside the two clamping grooves.

* * * * *